US005248291A

United States Patent [19]

DeNoon et al.

[11] Patent Number: 5,248,291

[45] Date of Patent: Sep. 28, 1993

[54] RE-FOLDING APPARATUS FOR CONTINUOUS FEED PAPER

[76] Inventors: William J. DeNoon, 1053 Feise Rd., O'Fallon, Mo. 63366; Bobby G. Davidson, 7 Woodview, Lake St. Louis, Mo. 63367

[21] Appl. No.: 839,347

[22] Filed: Feb. 20, 1992

[51] Int. Cl.[5] ..... B65H 45/20

[52] U.S. Cl. ..... 493/410; 493/411; 493/412; 493/413; 493/414; 493/415

[58] Field of Search ..... 493/410–415, 493/422, 423, 451; 270/40

[56] References Cited

U.S. PATENT DOCUMENTS

| | | | |
|---|---|---|---|
| 3,086,768 | 4/1963 | Lach | 493/415 |
| 3,363,895 | 1/1968 | Abe | 493/410 |
| 4,547,184 | 10/1985 | Bunch, Jr. . | |
| 4,723,488 | 2/1988 | Inouye | 493/414 |
| 4,838,848 | 6/1989 | Lenzi . | |
| 4,846,454 | 7/1989 | Parkander . | |
| 5,029,828 | 7/1991 | Sato et al. . | |
| 5,110,101 | 5/1992 | Roth | 493/410 |

*Primary Examiner*—Bruce M. Kisliuk
*Assistant Examiner*—Jack Lavinder
*Attorney, Agent, or Firm*—Jerome A. Gross

[57] ABSTRACT

Continuous fan-fold paper, the flexure of whose folds has been lessened by laser printing, is re-stacked between a pair of paddle towers whose paddles, hinged on continuous vertical belts, urge the paper into folds at its transverse perforations. No synchronization of paddles with the printer is required.

13 Claims, 4 Drawing Sheets

RE-FOLDING APPARATUS FOR CONTINUOUS FEED PAPER

BACKGROUND OF THE INVENTION

1. Field of the Invention

This invention relates to an apparatus for re-folding and re-stacking continuous feed paper along its transverse perforations after printing, in which the apparatus does not have to be synchronized with the printer.

2. Description of the Prior Art

While re-folding of continuous feed paper after printing into perfect stacks has always been somewhat problematic, wire basket configurations and box-like collectors have generally been sufficient to deal with problems caused by traditional printers. The advent of laser printers has greatly increased re-folding problems. The heat and pressure generated by laser printers causes the folds at the perforations to be "ironed" flat, severely lessening their flexure. Further complicating re-folding is the fact that the paper travels out of these newer printers at a much greater speed than with older printers, making traditional collection methods inadequate. If stacking collection is to be made within a rectangular basket, failure of the paper to re-fold at even one fold line may result in the rapidly fed paper spilling at random over the basket sides.

Several folders have been developed to address these problems. The most common construction utilizes an oscillating chute to direct the paper first to one side and then the other, thus to form the folds at both edges. Another folder, shown in U.S. Pat. No. 5,029,828 to Sato, uses rotating blades to flex the paper's perforations and aid folding.

A major drawback of these folders is that they all must be synchronized with the output of the printer, either by an electrical connection to the printer or by a perforation sensing mechanism. Synchronization complicates construction and maintenance costs.

SUMMARY OF THE INVENTION

The present invention overcomes these drawbacks by providing a reliable self-contained unit which does not require any synchronization with the printer.

Continuous feed paper to be re-folded after printing comes in contact with an agitator which partially lessens its stiffness at the fold lines; this may be a rotating beater brush with a single line of bristles. This agitation of the paper flexes the paper. The paper then moves downward toward a stacking support between paddle tower structures. The towers each contain a continuous belt of hinged paddles, which urge the paper into folds. As each paddle reaches the top of the paper stack, it presses the fold firmly onto the stack and then deflects upward on its hinge to pass outwardly of the stack.

DESCRIPTION OF THE PREFERRED EMBODIMENT

Figure 1:
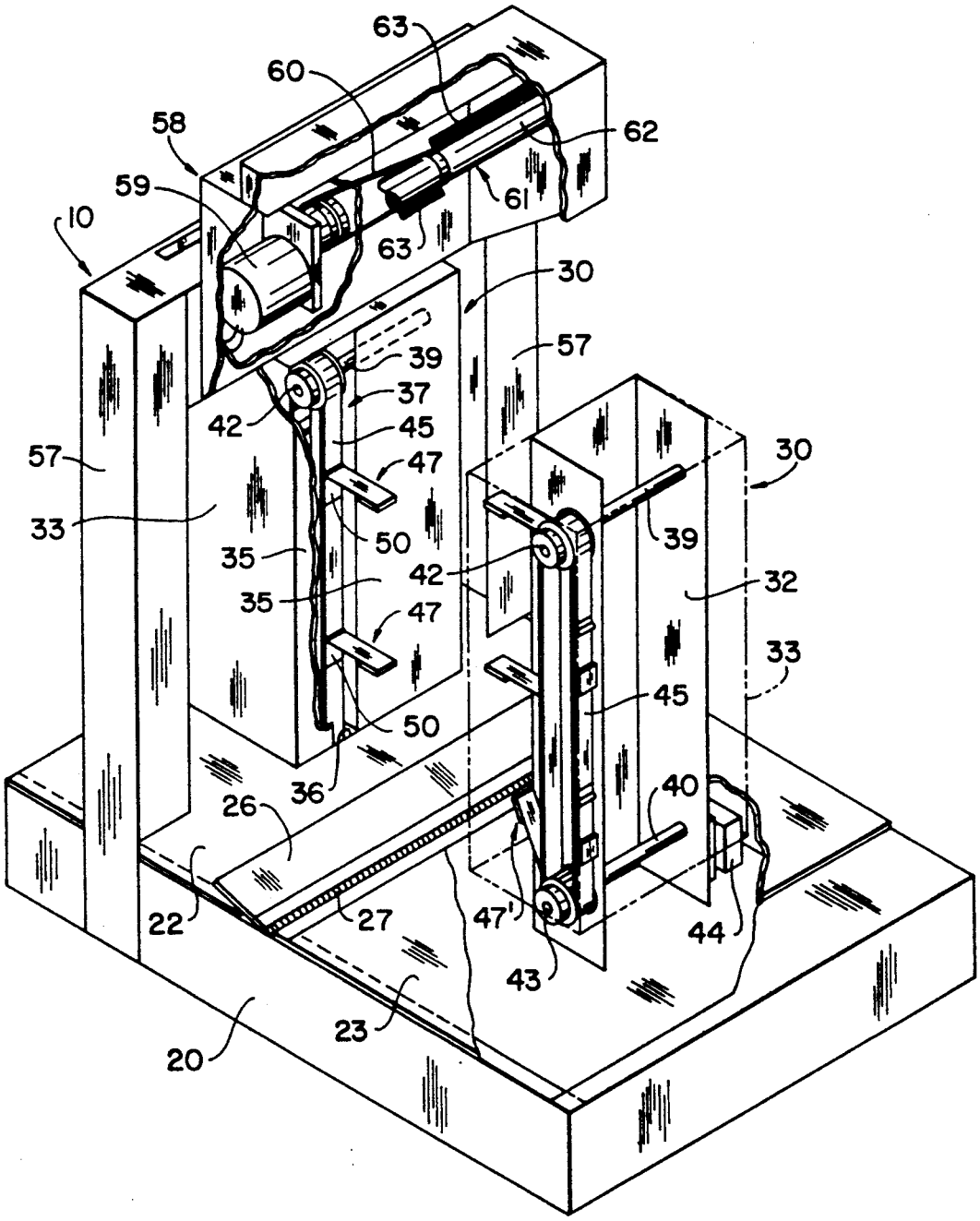
FIG. 1 is an isometric view of the re-folding device embodying the present invention. The cover on the agitation mechanism shown in the upper left hand side is broken away to show the motorized beater brush configuration. The shield of the paddle tower to the right is drawn in phantom lines and the right side of the tower support surface is broken away to show the tower construction and the motorized paddle belt.
Figure 3:
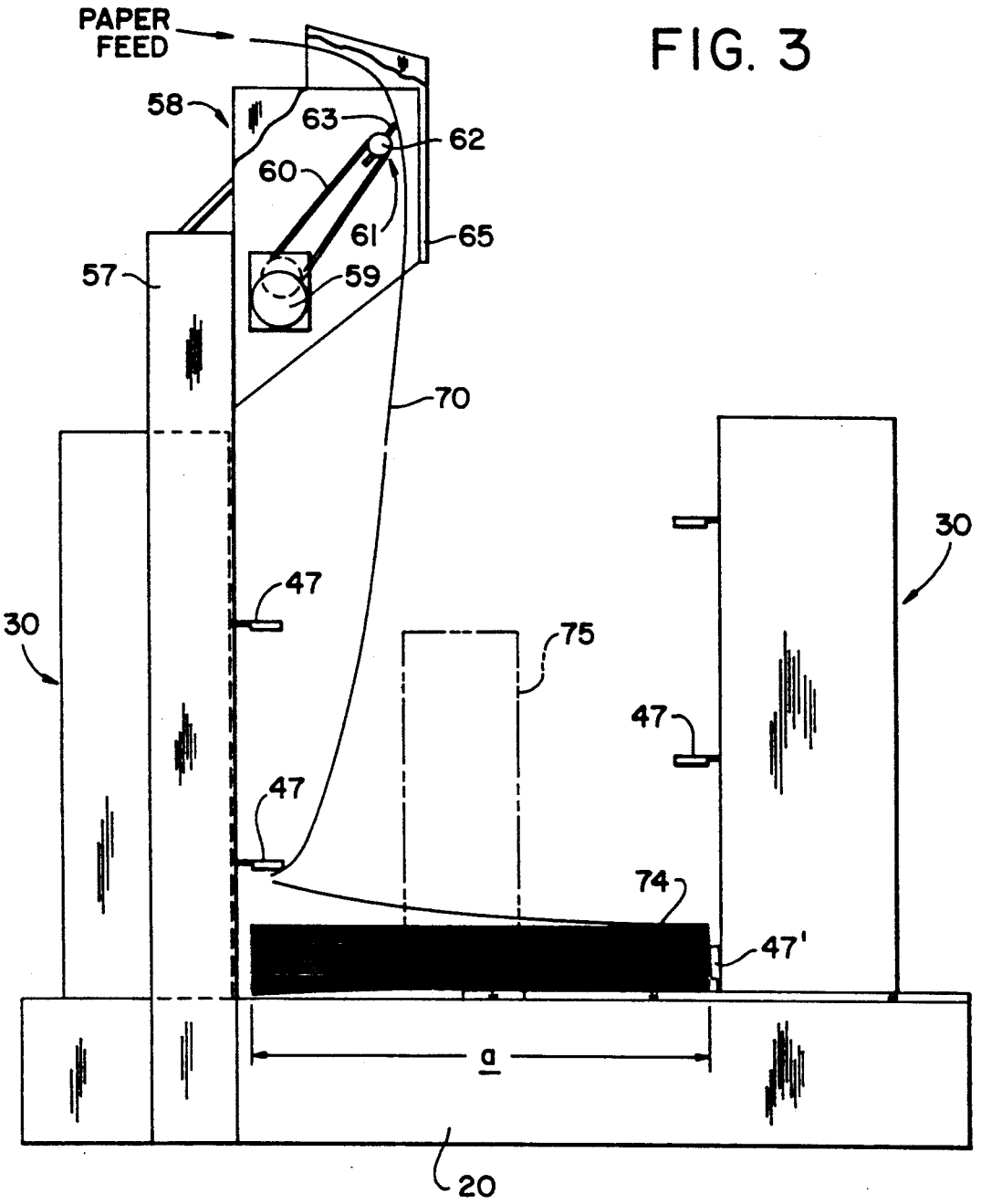
FIG. 3 is a side view of the FIG. 1 apparatus, illustrating the re-folding of continuous feed paper. The towers are shown in their outward position. Optional paper guides are shown in phantom lines.
Figure 4:
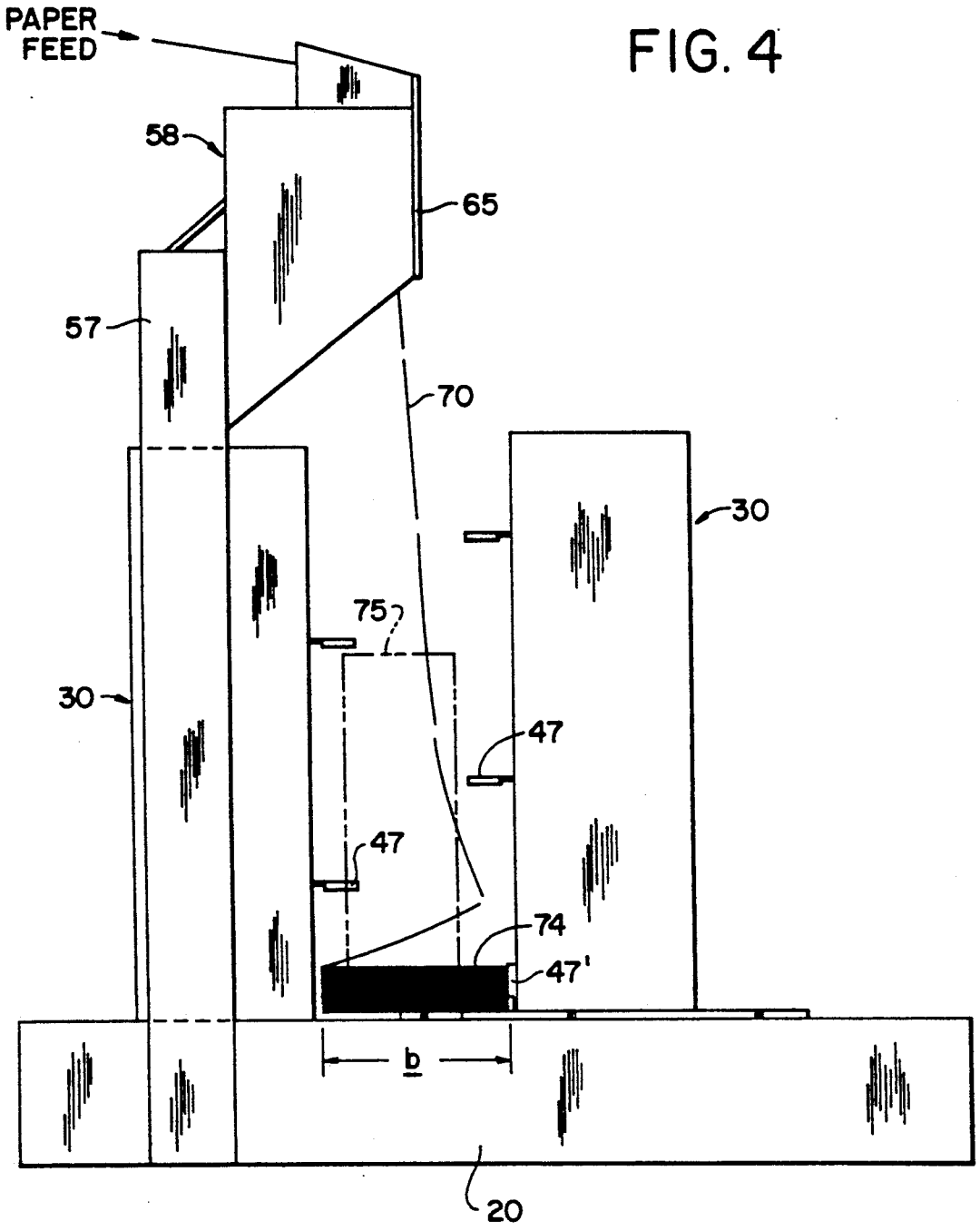
FIG. 4 is a side view of the FIG. 1 apparatus. The towers have been adjusted inward from their FIG. 3 position to allow re-folding of paper with a shorter distance between perforations. Optional paper guides are shown in phantom lines.

The re-folding apparatus 10 of the present invention shown in FIG. 1 is preferably constructed of a platform base 20 with tower support surfaces 22, 23 adjustably mounted on the base 20. Each tower support surface 22, 23 supports a paddle tower generally designated 30. The portion of the support surfaces 22 and 23 between the paddle towers 30 is the stacking support surface generally designated 24. The width of the stacking support surface 24 (i.e. to support the re-folded paper) can be varied by moving the support surfaces 22 and 23 as shown in FIGS. 3 and 4 to accommodate varying sizes of materials to be re-folded. One support surface 23 preferably has an extension 26 connected by a piano hinge 27 to partially overlay the other support surface thus to allow positioning of the towers 30 with their support surfaces 22 and 23, without a gap in the stack support portion 24.

The paddle towers 30 of the preferred embodiment each include a channel-like shield 33 to protect personnel and moving parts, which is attached to a support surface 22, 23. A structural channel 32, which also functions as a partial shield, is aligned with one of the shields 33 on its inward-facing side, so as to form a stacking guide surface 35 interrupted by a vertical slot 37. The lower end of channel 32 extends below the tower support surface 22, 23 into the platform base 20, and supports a lower horizontal shaft 40 to which is fastened a lower cogwheel 43. A motor 44 is connected to lower shaft 40 for rotation as hereinafter described. The upper end of channel 32 supports an upper shaft 39 and cogwheel 42, aligned parallel to the lower shaft 40. A continuous cog belt 45 is attached about the cogwheels 42, 43 in alignment with slot 37. The cog belt 45 is set inward from slot 37 to form a gap 36 between the cog belt 45 and the stacking support surface 24. In this preferred construction, cog belt 45 turns on lower cogwheel 43 below the stacking support surface 24. The speed of the movement of cog belt 45 is preferably slightly less than the speed of the sheet material to be re-folded, for example, a belt 45 speed of substantially 15.5 ft./min. to re-fold paper moving at a speed of substantially 16 ft./min. No synchronization with the perforations is necessary.

Figure 2:
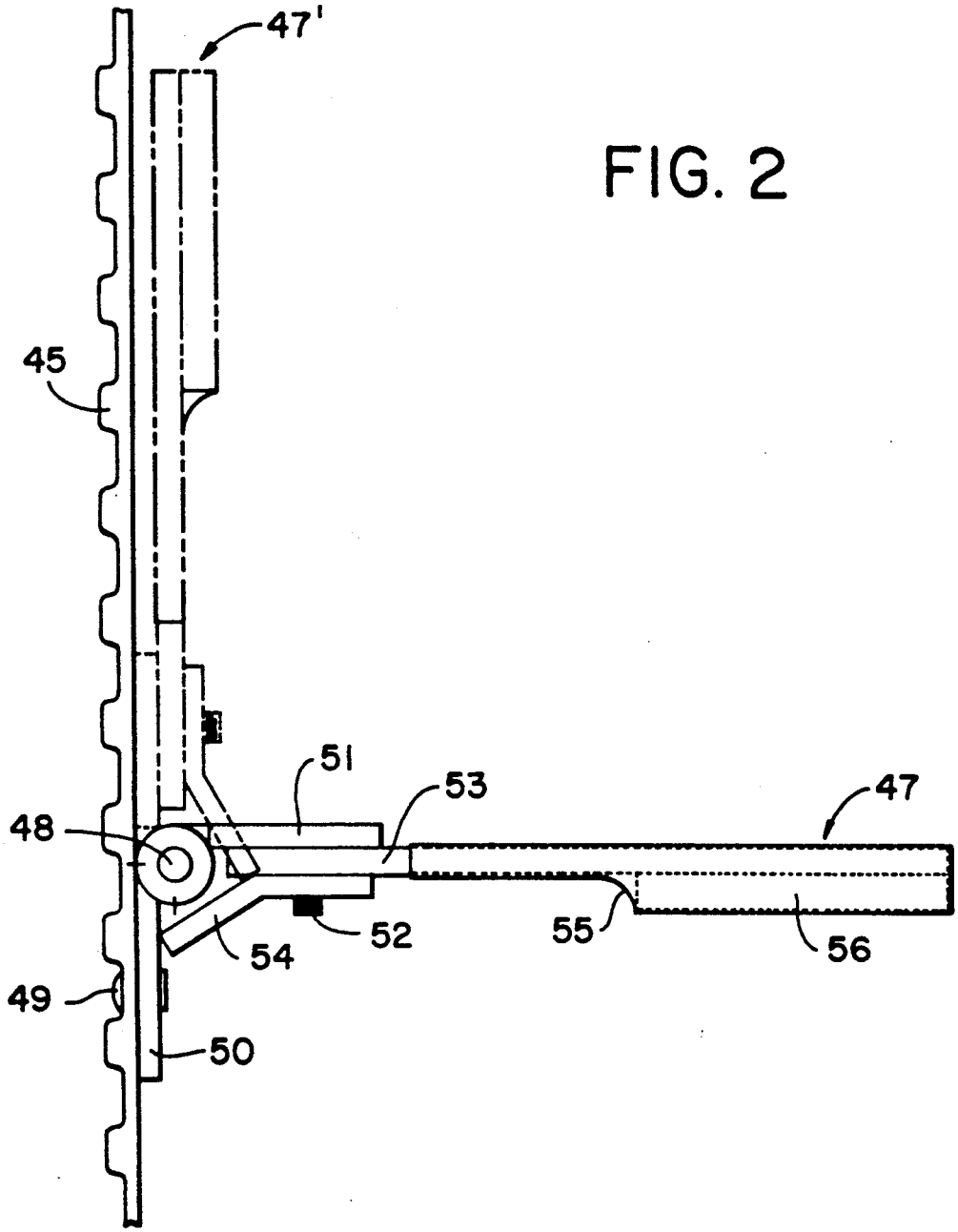
FIG. 2 is a side view of the hinged paddle assembly of the apparatus shown in FIG. 1. The paddle is shown attached to a cog belt and is held in a substantially horizontal position by a hinge stop. The paddle is shown in a retracted upward position by phantom lines.

Paddles generally designated 47 are attached to cog belt 45 as seen in FIG. 2 at intervals preferably less than twice the length of the paper as measured by distance between perforations —say for example paddles being substantially 8" apart to re-fold material with as small a distance between the perforations as 5".

In the preferred construction, the paddle 47 is connected to the cog belt 45 by a hinge 48, which allows the paddle 47' to deflect upward, as shown by phantom lines in FIG. 2. One hinge leaf 50 is attached to the cog belt 45 by rivet 49. The second hinge leaf 51, is connected to a substantially rigid paddle 53 and a hinge stop 54 by screw 52 to prevent the paddle 47 from drooping below a substantially horizontal position when the cog belt 45 is moving in a downward direction.

The presently preferred paddle material 53 is a laminated belting. The projecting end of paddle 47 is weighted by a steel weight 56, held to paddle 47 by shrinkable plastic tubing 55. The plastic tubing 55 provides simple construction, as well as a smooth surface for contact with the paper to be refolded. The paddles 47 when in a substantially horizontal position project across the gap 36 and through slot 37 of the stacking guide surface 35. As presently preferred, the total length of paddle 47 is about 3", with substantially 2⅝" of paddle 47 projecting beyond slot 37, and the width of the paddle is presently substantially 1".

To avoid interference of the portion of the rivets 49 which protrude from the side of the belt 45 opposite the paddles 47 with the engagement of the cog belt 45 on the cogwheels 42, 43, each cogwheel 42, 43 is preferably "wrapped" with tape or shrink plastic. This "wrapping" prevents the cog belt 45 from interlocking fully with the cogwheels 42, 43 allowing an area between the belt 45 and the cogwheels 42, 43 for the rivets 49 to pass. An added advantage of this construction is a lessening of operating noise.

An agitator mechanism generally designated 58, shown in FIG. 1, is supported substantially above said towers in a way so as not to interfere with the adjustable movement of the support surface 22 and its corresponding paddle tower 30. The preferred agitator is a beater brush generally designated 61 with two half rows of bristles 63 extending outwardly from the shaft 62 of the brush 61, substantially located 180° apart from each other. A belt 60 connects the beater brush 61 to a motor 59 for powering. The agitation mechanism 58 is enclosed on the top and front by a guide cover 65.

As used to re-fold paper after laser printing, the towers 30 are first adjusted so that the space between them—the stacking surface 24—is slightly greater than the distance between the transverse perforations of the paper 70, preferably about ½". FIG. 3 illustrates the towers 30 at an outward position, to re-fold paper with a distance a between the perforations. FIG. 4 illustrates the towers 30 adjusted to an inward position, for use with paper having a distance b between the perforations. The gaps in the paper 70 represent the locations of the perforations.

When the continuous fan-fold sheet paper 70 to be refolded enters the agitator 58 it comes in repeated contact with the bristles 63 as the beater brush 61 rotates. The paper 70 is then directed by guide cover 65 in a downward direction toward stacking surface 24 as shown in FIGS. 3 and 4.

The paper 70 reaching the stacking surface 24 begins to lay down on the stacking surface 24 and begins moving toward one of the towers 30. Upon contact with the paper 70, a downward moving paddle 47 begins to press a fold at the perforations. After pressing the fold firmly the paddle 47' then deflects upwardly on hinge 48 into the gap 36 to allow it to pass outward of the paper stack 74 being formed and the support surfaces 22, 23 as the cog belt 45 continues to turn. The paper 70 then begins laying down on the uppermost sheet surface or fold, while moving toward the opposite tower 30. A paddle 47 on the opposite tower 30 presses a fold into the paper 70 at the perforations. The paddle 47' retracts upwardly into gap 36 and passes outward of the paper stack 74. This process continues until all of the paper 70 is refolded into a uniform stack 74.

Optional side edge paper guides 75 are shown in phantom lines in FIG. 3 and 4. It is preferred to utilize guides 75 conveniently held to support surfaces 22, 23 by magnets.

This apparatus, while especially useful to re-fold paper, can also be used to fold any material in which the line of weakening has been stiffened, by laser printing or other processes which result in the folds losing flexure.

While the use of the two tower configuration in combination with an agitator is preferred for successful re-folding over the broadest range of applications, alternative configurations are possible. In certain instances, such as where re-folding is troublesome because of a coating on one side or with label stock, use of one paddle tower may be sufficient. Furthermore, in cases where the material retains some of the flex at its perforations, re-folding may be accomplished without use of an agitator.

While the beater brush agitator is preferred, any method of physical agitation which "jostles" the material sufficiently to flex the material at its perforations thereby to lessen heat and pressure effects may be used. Alternate agitators include a beater brush with a different bristle configuration; for example one row of bristles straight across the brush, or the use of solid blades in place of bristles.

The wrapped cogwheel/cog belt construction is preferred to prevent slippage of the belt on the wheel, but any pulley and belt system of sufficient strength to withstand the forces on the paddle during re-folding may be used. The belt may be made of any suitable material including chain.

The paddles may be constructed in any way to afford a projection while moving downward and retraction to pass outwardly around the stack. A one-piece construction where the weight of the paddle is sufficient to accomplish re-folding may be preferable in certain circumstances.

Since various modifications may be made in the apparatus and use herein described without departing from the scope of the invention, all matter contained in the foregoing description shall be taken as illustrative rather than limiting.

We claim:

1. Apparatus for re-stacking downward-moving continuous fan-fold sheet material by re-folding along transverse perforations therethrough, comprising apparatus support means extending upward from a base level, substantially horizontal means above such base level to permit re-stacking thereon of such fan-fold sheet material, and a paddle tower extending from a lower tower end at least as low as said horizontal means, upward to an upper end substantially thereabove, said paddle tower being adjacent to an edge of said substantially horizontal means to permit re-stacking, and having parallel rotatable upper and lower horizontal shafts supported by and adjacent to the upper and lower ends of said paddle tower respectively, upper and lower pulley means secured to said upper and lower shafts respectively and in parallel alignment with each other, continuous belt drive means about said upper and lower pulleys, motor means to move downward that side of said drive means adjacent to said horizontal means to permit re-stacking, there being a gap between said means to permit re-stacking and said belt drive means, said belt drive means having a plurality of projecting paddle-like means attached at intervals therealong, each said paddle-like means having means at its attachment, effective on its downward movement to prevent drooping substantially below horizontal and means to permit deflection upward and toward said continuous drive means, each paddle-like means being of such extent as, when supported by said droop-preventing support means, to extend across said gap, whereby when such fan-fold material descends from above onto said horizontal means to permit re-stacking and deflects toward said tower, said downward moving paddle-like means may press the fan-fold material re-foldingly along transverse perforations, and on reacting to such pressing, said paddle-like means may deflect upward and toward said continuous drive means, thereby to pass downward outwardly of the folds and through said gap for return upwardly on the opposite side of said tower.

2. Apparatus for re-stacking as defined in claim 1, further comprising a second paddle tower similarly constructed and supported adjacent to and spaced from an opposite edge of said horizontal means to permit re-stacking.

3. Apparatus for re-stacking downward-moving continuous fan-fold sheet material by re-folding along its transverse perforations, comprising a platform base means, a substantially horizontally tower support surface mounted on said platform base means at a level above the lowermost portion of said base means, said tower support surface including a stacking support portion, a paddle tower supported by said tower support surface and extending both substantially thereabove and therebelow, parallel rotatable upper and lower shafts supported by and adjacent to the upper and lower ends of said paddle tower respectively, an upper and a lower pulley secured to said upper and lower shafts respectively and in parallel alignment with each other, a continuous belt-like drive means about said upper and lower pulleys, motor means to move downward that side of said drive means adjacent to said stacking support portion, and a plurality of projecting paddle means attached at intervals along said drive means, said paddle means having means, effective on their downward movement, to prevent drooping substantially below horizontal but permit deflection upward and toward said drive means, whereby when such fan-fold material descends from above onto said stacking support portion and deflects toward said tower, the downward moving paddle means may press the fan-fold material re-foldingly along its transverse perforations for stacking and on reacting to such pressure, said paddle means may deflect upward and toward said drive means, thereby to pass downward outwardly of the folds so re-formed.

4. Apparatus as defined in claim 3, further including a second support surface mounted on said platform base, and a second paddle tower, similar to said first tower mounted on said second support surface with its downward-moving paddle side facing the corresponding side of said first paddle tower, whereby both edges of such fan-fold sheet material may be so re-folded.

5. Apparatus as defined in claim 4, wherein both said paddle towers have vertical channel-like shield means extending upward from its stack support surface and a vertical gap in said shield means through which said paddle means may project.

6. Apparatus as defined in claim 4, wherein said first and second support surfaces are adjustably positionable on said platform base, whereby to permit re-folding of fan-fold sheet material of a variety of sheet lengths.

7. Apparatus as defined in claim 6, wherein that edge of said second support surface which extends toward said first paddle tower is a hinged extension adapted to rest upon the first support surface, whereby to permit such adjustable positioning over a range of adjustment without a gap in support of such re-folded sheet material.

8. Apparatus as defined in claim 4, wherein the speed of movement of said belt-like drive means does not exceed the original downward movement of the fan-fold sheet material prior to commencement of re-folding, whereby the projecting paddle means may urge re-forming of the folds without likelihood of damaging the re-folding edges of such materials.

9. Apparatus as defined in claim 4 wherein said belt-like means is a cog belt and said upper and lower pulleys are cogwheels.

10. Apparatus as defined in claim 4, wherein said means, effective on downward movement to prevent drooping but permit upward deflection comprises a hinge and a stop against downward movement.

11. Apparatus as defined in claim 4, in combination with an agitator means positioned at a level above said towers, for receiving a flow of such perforated sheet material to be re-folded, said agitator means extending transverse to the line of such flow, whereby agitation of such sheet material causes such perforations to flex, thereby facilitating re-folding and re-stacking of such material.

12. The apparatus as defined in claim 11 wherein said agitator means comprises a rotatable beater brush including a row of bristles extending thereacross.

13. The apparatus as defined in claim 11 wherein said agitator means comprises a rotatable blade.

* * * * *